US006432263B2

(12) United States Patent
Gehr et al.

(10) Patent No.: US 6,432,263 B2
(45) Date of Patent: Aug. 13, 2002

(54) PROCESS FOR INCREASING THE WATER RETENTION CAPACITY IN FIBROUS WEBS

(75) Inventors: Volker Gehr, Baienfurt; Almut Kriebel; Volker Niggl, both of Weingarten; Hans-Ludwig Schubert, Baienfurt, all of (DE)

(73) Assignee: Voith Paper Patent GmbH, Ravensburg (DE)

( * ) Notice: Subject to any disclaimer, the term of this patent is extended or adjusted under 35 U.S.C. 154(b) by 0 days.

(21) Appl. No.: 09/726,455

(22) Filed: Dec. 1, 2000

(30) Foreign Application Priority Data

Dec. 3, 1999 (DE) ..... 199 58 038

(51) Int. Cl.[7] ..... D21C 5/02

(52) U.S. Cl. ..... 162/6; 162/4; 162/26; 162/56; 162/65

(58) Field of Search ..... 162/6, 4, 26, 56, 162/65

(56) References Cited

U.S. PATENT DOCUMENTS 5,958,179 A * 9/1999 Gehr et al. ..... 162/6

OTHER PUBLICATIONS

Kriebel et al., "Beeinflussung von Fasereigenschaften durch Scheiben–Disperger und Knet–Disperger", Wochenblatt für Papierfabrikation 23/24, pp 1212–1217, 1998.

* cited by examiner

*Primary Examiner*—Peter Chin
*Assistant Examiner*—Mark Halpern
(74) *Attorney, Agent, or Firm*—Greenblum & Bernstein, P.L.C.

(57) ABSTRACT

Process for increasing the water retaining ability of fibrous paper stocks. The process includes knead dispersing a fibrous paper stock having a stock concentration of at least about 20% and a temperature greater than about 45° C. A treatment for the knead dispersing is at least about 10 seconds. The process further includes completing a post-treatment phase to a machine tub of a paper machine in a reaction time of no longer than about 30 minutes.

34 Claims, 1 Drawing Sheet

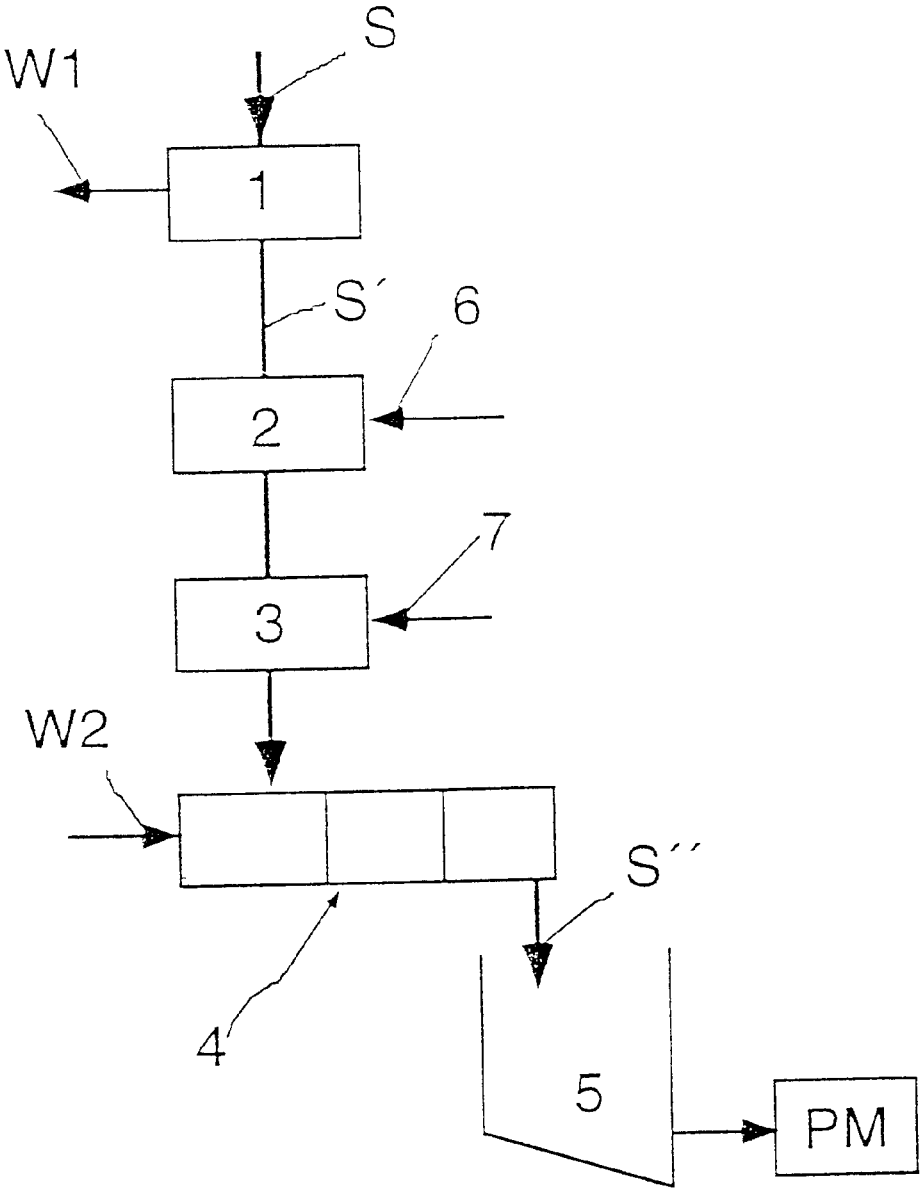
S
W1
1
S´
6
2
7
3
W2
S´´
4
5
PM

PROCESS FOR INCREASING THE WATER RETENTION CAPACITY IN FIBROUS WEBS

CROSS-REFERENCE TO RELATED APPLICATIONS

The present application claims priority under 35 U.S.C. §119 of German Patent Application No. 199 58 038.3, filed on Dec. 3, 1999, the disclosure of which is expressly incorporated by reference herein in its entirety.

BACKGROUND OF THE INVENTION

1. Field of the Invention

The present invention relates to a process for increasing the water retention capacity in fibrous paper stocks in which a knead dispersing, which is known per se, is used in connection with further measures for achieving this goal.

2. Discussion of Background Information

It is known that the water retention capacity is an important feature of fibrous paper stocks and first influences the production conditions in the production of the paper in the paper machine. Additionally, it also influences the quality and usability of finished paper. Paper that was produced from a fibrous paper stock with a higher ability of retaining water has a better liquid intake capacity and an increased absorption capacity.

In the paper A Kriebel and R. Sigl, "Beeinflussung von Fasereigenschaften durch Scheiben-Disperger und Knet-Disperger" in Wochenblatt für Papierfabrikation 23/24 1998, the effect of knead dispersers is described and explained in detail using various conditions and various original materials. Here, it is also mentioned that the increased porosity can be the result of a curling caused by knead dispersing. When performing the processes suggested here, obviously no improvement of the water retention capacity can be achieved; to the contrary, a lower deterring resistance is referred to as the result of this treatment.

SUMMARY OF THE INVENTION

Therefore, the present invention provides a process that improves the water retention capacity in fibrous paper stocks.

According to the process of the invention, a fibrous paper stock with a stock concentration of at least about 20% and a temperature greater than about 45° C. is treated by knead dispersing for a treatment time of at least about 10 seconds, and, following the knead dispersing, a post-treatment phase to a machine tub of a paper machine is completed in a reaction time of no longer than about 30 minutes.

When combining a knead dispersing at relatively high temperatures and, consecutively, a rather short post-treatment phase, better water retention values can be achieved than have been available until now in the prior art. The desired effect can be achieved with the new process even while decreasing the grade of grinding or at least without increasing it.

Embodiments of the process according to the invention provide for an additional steam treatment of the paper fibers to occur, which can be performed, e.g., before or during the knead dispersing. The effect can also be supported by adding chemicals, e.g., ozone, which allows an additional improvement.

The present invention is directed to a process for increasing the water retaining ability of fibrous paper stocks. The process includes knead dispersing a fibrous paper stock having a stock concentration of at least about 20% and a temperature greater than about 45° C. A treatment for the knead dispersing is at least about 10 seconds. The process further includes completing a post-treatment phase to a machine tub of a paper machine in a reaction time of no longer than about 30 minutes.

In accordance with a feature of the instant invention, the post-treatment phase can follow the knead dispersing.

According to another feature of the invention, the knead dispersing may be performed at a stock temperature greater than about 90° C., further, the knead dispersing can be performed at a stock temperature greater than 110° C.

A total specific work rate in the post treatment phase may not greater than about 10 kWh/to, and, preferably, the total specific work rate in the post treatment phase is not greater than about 5 kWh/to.

A temperature of the stock in the post treatment phase may be set at not greater than about 70° C., and, preferably, the temperature of the stock in the post treatment phase is set at not greater than about 50° C.

According to still another feature of the present invention, the reaction time of the stock in the post treatment phase may be a maximum of about 8 minutes.

Further, no machines for grinding paper fibers are utilized in the posttreatment phase.

In accordance with another feature of the invention, steam treatment of the paper stock may occur before or during the knead dispersing.

The process can further include introducing chemicals into the fibrous paper stock one of before and during the knead dispersing. The introduced chemicals may contain ozone gas.

Moreover,.the process may include increasing a temperature of the stock during the knead dispersing to a temperature of at least about 90° C., and, preferably, the stock temperature during knead dispersing may be increased to at least about 110° C. Further, the process can include reducing the temperature of the stock during the post-treatment phase to not greater than 70° C., and, preferably, the stock temperature in the post-treatment phase may be reduced to not greater than 50° C.

According to a further feature of the invention, the process can include introducing an amount of work to the stock during the post-treatment phase of less than about 10 kWh/to, and, preferably, the amount of work introduced to the stock during post-treatment can be less than about 5 kWh/to.

Moreover, the process may also include at least one of steam and chemicals to the stock one of before and during the knead dispersing. The chemicals can include ozone gas. Further, both the steam and the chemicals may be introduced to the stock one of before and during the knead dispersing.

The present invention is directed to a process for increasing the water retaining ability of fibrous paper stocks. The process includes knead dispersing a fibrous paper stock having a stock concentration of at least about 20% and a temperature greater than about 45° C. A treatment for the knead dispersing is at least about 10 seconds. The process also includes post-treating the stock with a reaction time of no longer than about 30 minutes, and forwarding the stock to a tub of a paper making machine.

According to a feature of the present invention, the process can further include introducing chemicals into the fibrous paper stock one of before and during the knead dispersing. The introduced chemicals can contain ozone gas.

The process can also include further comprising increasing a temperature of the stock during the knead dispersing to a temperature of at least about 90° C., and, preferably, the stock temperature during knead dispersing may be increased to at least about 110° C. Further, the process may include, during the post treating, reducing the temperature of the stock to not greater than 70° C., and, preferably, the stock temperature in the post treating may be reduced to not greater than 50° C.

In accordance with another feature of the invention, the post treating may include introducing an amount of work to the stock during the post-treatment phase of less than about 10 kWh/to, and, preferably, the amount of work introduced to the stock during the post treating may be less than about 5 kWh/to.

In accordance with yet another feature of the instant invention, the process can further include introducing at least one of steam and chemicals to the stock one of before and during the knead dispersing. The chemicals may include ozone gas. Further, both the steam and the chemicals can be introduced to the stock one of during and before the knead dispersing.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the drawing by way of a non-limiting example of an exemplary embodiments of the present invention, wherein:

The FIGURE illustrates features of the process in accordance with the present invention.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

According to the exemplary process depicted in FIG. 1, a fibrous paper stock S undergoes a dewatering 1, in which some of the water W1 is removed in order to achieve a necessary stock concentration of at least about 20% dry content. This highly consistent material, now present as a crumbling stock S', is heated in a heater 2, e.g., by adding steam 6, so that a selected temperature of more than about 45° C., and preferably in a range of about 90° C. or higher, is achieved. The hot material is then treated by knead dispersing 3, e.g., in a knead disperser. During knead dispersing 3, chemicals 7, e.g., ozone gas, might be added which further increase the effectiveness of the process. Further, the introduction of steam and/or chemicals can occur either in front of or in the knead disperser. In the knead disperser, which is utilized for the knead dispersing process, treatment tools can be moved relative to one another, which is known per se, with the distance being generally several millimeters and a maximal relative speed being below about 15 m/sec.

After knead dispersing 3, the stock arrives in a post-treatment phase 4 which at least includes dilution with water W2. Stacking and mixing, if present, can also be part of post-treatment phase 4. It is important for the desired effect of the process that post treatment phase 4 be relatively short, e.g., not longer than about 30 minutes, and preferably no longer than about 15 min. It is also advantageous when, in post treatment phase 4, no more than a small specific amount of work is introduced into the stock, e.g., by pumps or mixers. It is noted that, a post-grinding or postdestippling would reduce the success of the instant process to a large extent and, therefore, should generally be omitted. In the end, the stock S" can be put into a machine tub 5 and be made available for a paper machine PM.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process for increasing the water retaining ability of fibrous paper stocks, comprising:

knead dispersing a fibrous paper stock having a stock concentration of at least about 20% and a temperature greater than about 45° C., wherein a treatment for the knead dispersing is at least about 10 seconds; and completing a post-treatment phase to a machine tub of a paper machine in a reaction time of no longer than about 30 minutes, whereby the treatment and post-treatment increase the water retaining ability of the fibrous paper stock.

2. The process in accordance with claim 1, wherein the post-treatment phase follows the knead dispersing.

3. The process in accordance with claim 1, wherein the knead dispersing is performed at a stock temperature greater than about 90° C.

4. The process in accordance with claim 3, wherein the knead dispersing is performed at a stock temperature greater than 110° C.

5. The process in accordance with claim 1, wherein a temperature of the stock in the post treatment phase is set at not greater than about 70° C.

6. The process in accordance with claim 5, wherein the temperature of the stock in the post treatment phase is set at not greater than about 50° C.

7. The process in accordance with claim 1, wherein the reaction time of the stock in the post treatment phase is a maximum of about 8 minutes.

8. The process in accordance with claim 1, wherein no machines for grinding paper fibers are utilized in the post-treatment phase.

9. The process in accordance with claim 1, wherein steam treatment of the paper stock occurs before or during the knead dispersing.

10. The process in accordance with claim 1, further comprising introducing chemicals into the fibrous paper stock one of before and during the knead dispersing.

11. The process in accordance with claim 10, wherein the introduced chemicals contain ozone gas.

12. The process in accordance with claim 1, further comprising increasing a temperature of the stock during the knead dispersing to a temperature of at least about 90° C.

13. The process in accordance with claim 12, wherein the stock temperature during knead dispersing is increased to at least about 110° C.

14. The process in accordance with claim 12, further comprising reducing the temperature of the stock during the post-treatment phase to not greater than 70° C.

15. The process in accordance with claim 14, wherein the stock temperature in the post-treatment phase is reduced to not greater than 50° C.

16. The process in accordance with claim 1, further comprising introducing at least one of steam and chemicals to the stock one of before and during the knead dispersing.

17. The process in accordance with claim 16, wherein the chemicals include ozone gas.

18. The process in accordance with claim 17, wherein both the steam and the chemicals are introduced to the stock one of before and during the knead dispersing.

19. A process for increasing the water retaining ability of fibrous paper stocks, comprising:

knead dispersing a fibrous paper stock having a stock concentration of at least about 20% and a temperature greater than about 45° C., wherein a treatment for the knead dispersing is at least about 10 seconds;

post-treating the stock with a reaction time of no longer than about 30 minutes; and forwarding the stock to a tub of a paper making machine, whereby the treatment and the post-treatment increase the water retaining ability of the fibrous paper stock.

20. The process in accordance with claim 19, further comprising introducing chemicals into the fibrous paper stock one of before and during the knead dispersing.

21. The process in accordance with claim 20, wherein the introduced chemicals contain ozone gas.

22. The process in accordance with claim 19, further comprising increasing a temperature of the stock during the knead dispersing to a temperature of at least about 90° C.

23. The process in accordance with claim 22, wherein the stock temperature during knead dispersing is increased to at least about 110° C.

24. The process in accordance with claim 22, further comprising, during the post treating, reducing the temperature of the stock to not greater than 70° C.

25. The process in accordance with claim 24, wherein the stock temperature in the post treating is reduced to not greater than 50° C.

26. The process in accordance with claim 19, further comprising introducing at least one of steam and chemicals to the stock one of before and during the knead dispersing.

27. The process in accordance with claim 26, wherein the chemicals include ozone gas.

28. The process in accordance with claim 27, wherein both the steam and the chemicals are introduced to the stock one of during and before the knead dispersing.

29. A process for increasing the water retaining ability of fibrous paper stocks, comprising:

knead dispersing a fibrous paper stock having a stock concentration of at least about 20% and a temperature greater than about 45° C., wherein a treatment for the knead dispersing is at least about 10 seconds; and completing a post-treatment phase to a machine tub of a paper machine in a reaction time of no longer than about 30 minutes, wherein a total specific work rate in the post treatment phase is not greater than about 10 kWh/to.

30. The process in accordance with claim 29, wherein the total specific work rate in the post treatment phase is not greater than about 5 kWh/to.

31. A process for increasing the water retaining ability of fibrous paper stocks, comprising:

knead dispersing a fibrous paper stock having a stock concentration of at least about 20% and a temperature greater than about 45° C., wherein a treatment for the knead dispersing is at least about 10 seconds;

completing a post-treatment phase to a machine tub of a paper machine in a reaction time of no longer than about 30 minutes; and introducing an amount of work to the stock during the post-treatment phase of less than about 10 kWh/to.

32. The process in accordance with claim 31, wherein the amount of work introduced to the stock during post-treatment is less than about 5 kWh/to.

33. A process for increasing the water retaining ability of fibrous paper stocks, comprising:

knead dispersing a fibrous paper stock having a stock concentration of at least about 20% and a temperature greater than about 45° C., wherein a treatment for the knead dispersing is at least about 10 seconds;

post-treating the stock with a reaction time of no longer than about 30 minutes; and forwarding the stock to a tub of a paper making machine, wherein the post treating comprises introducing an amount of work to the stock during the post-treatment phase of less than about 10 k Wh/to.

34. The process in accordance with claim 33, wherein the amount of work introduced to the stock during the post treating is less than about 5 kWh/to.

* * * * *